US011382395B2

(12) United States Patent
Lai

(10) Patent No.: US 11,382,395 B2
(45) Date of Patent: Jul. 12, 2022

(54) GRIP DEVICE FOR A POLE

(71) Applicant: Hsin-Yuan Lai, Taichung (TW)

(72) Inventor: Hsin-Yuan Lai, Taichung (TW)

( * ) Notice: Subject to any disclaimer, the term of this patent is extended or adjusted under 35 U.S.C. 154(b) by 0 days.

(21) Appl. No.: 17/178,334

(22) Filed: Feb. 18, 2021

(65) Prior Publication Data

US 2021/0307463 A1 Oct. 7, 2021

(30) Foreign Application Priority Data

Apr. 1, 2020 (TW) ..... 109203841

(51) Int. Cl.
*A45B 9/02* (2006.01)

(52) U.S. Cl.
CPC ..... *A45B 9/02* (2013.01); *A45B 2009/025* (2013.01)

(58) Field of Classification Search
CPC .. A45B 9/02; A45B 2009/025; A63C 11/2224
See application file for complete search history.

(56) References Cited

U.S. PATENT DOCUMENTS 5,443,287 A * 8/1995 Wells ..... A63C 11/2224 280/822
6,439,610 B1 8/2002 Pronzati
8,453,661 B2 * 6/2013 Hutt ..... B25G 1/102 135/66
8,915,522 B2 * 12/2014 Roiser ..... A45B 9/02 280/820
9,027,206 B2 * 5/2015 Guyoton ..... A63C 11/2224 16/114.1
9,526,974 B2 * 12/2016 Bennert ..... A63C 11/227
2015/0251077 A1 * 9/2015 Pedersen ..... A63C 11/2224 280/821
2020/0069009 A1 * 3/2020 Böing ..... A63C 11/2224

FOREIGN PATENT DOCUMENTS

DE 2656814 A1 * 6/1978

* cited by examiner

*Primary Examiner* — Noah Chandler Hawk
(74) *Attorney, Agent, or Firm* — Burris Law, PLLC

(57) ABSTRACT

A grip device for a pole includes a grip and a wrist strap unit. The grip has a connecting part that defines a connecting space therein, and that has a lower portion and a protruding portion disposed in the connecting space. The wrist strap unit includes a connecting member that engages removably the connecting space, and that has a tail part. The tail part is pivotable between a locked position, where the tail part is adjacent to the lower portion so that the connecting member is retained in the connecting space by the protruding portion, and an unlocked position, where the tail part is away from the lower portion and the protruding portion so that the connecting member is permitted to be separated from the connecting part.

9 Claims, 5 Drawing Sheets

GRIP DEVICE FOR A POLE

CROSS-REFERENCE TO RELATED APPLICATION

This application claims priority to Taiwanese Utility Model Patent Application No. 109203841, filed on Apr. 1, 2020.

FIELD

The disclosure relates to a grip device, and more particularly to a grip device for a pole.

BACKGROUND

A conventional grip device for a pole such as a pole for skiing, trekking, or hiking, is generally equipped with a wrist strap. The wrist strap is used for tying on a wrist of a user so as to ensure a firm grip without putting too much stress and strain on the user's hand, and further to prevent the pole from being lost when the user's grip on the pole handle becomes loose.

The abovementioned conventional grip device is disclosed in, for example, U.S. Pat. No. 6,439,610, which includes a grip body, and a wrist strap that is fixed to the grip body. One disadvantage of the conventional grip device is that when the user falls down, or when the pole is stuck into the ground or snow, the user might receive wrist or hand injuries from the pole because the pole is still strapped to his/her wrist.

SUMMARY

Therefore, an object of the disclosure is to provide a grip device fora pole that can alleviate the drawback of the prior art.

According to the disclosure, the grip device includes a grip and a wrist strap unit. The grip has a connecting part that defines a connecting space therein. The connecting part has an upper portion, a lower portion, an opening, and a protruding portion. The upper portion is located over the connecting space. The lower portion is located under the connecting space. The opening is located between the upper portion and the lower portion, and communicates with the connecting space and the external environment. The protruding portion is connected to the lower portion, is disposed in the connecting space, and is adjacent to the opening.

The wrist strap unit includes a connecting member and a wrist strap. The connecting member engages removably the connecting space, and has a head part and a tail part. The head part and the tail part are respectively distal from and adjacent to the opening of the connecting part of the grip. The tail part is pivotable, with the head part serving as a pivot, between a locked position and an unlocked position. At the locked position, the tail part is adjacent to the lower portion of the connecting part of the grip so that the connecting member is retained in the connecting space by the protruding portion of the connecting part. At the unlocked position, the tail part is away from the lower portion and the protruding portion of the connecting part so that the connecting member is permitted to be separated from the connecting part. The wrist strap is connected to the tail part of the connecting member.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
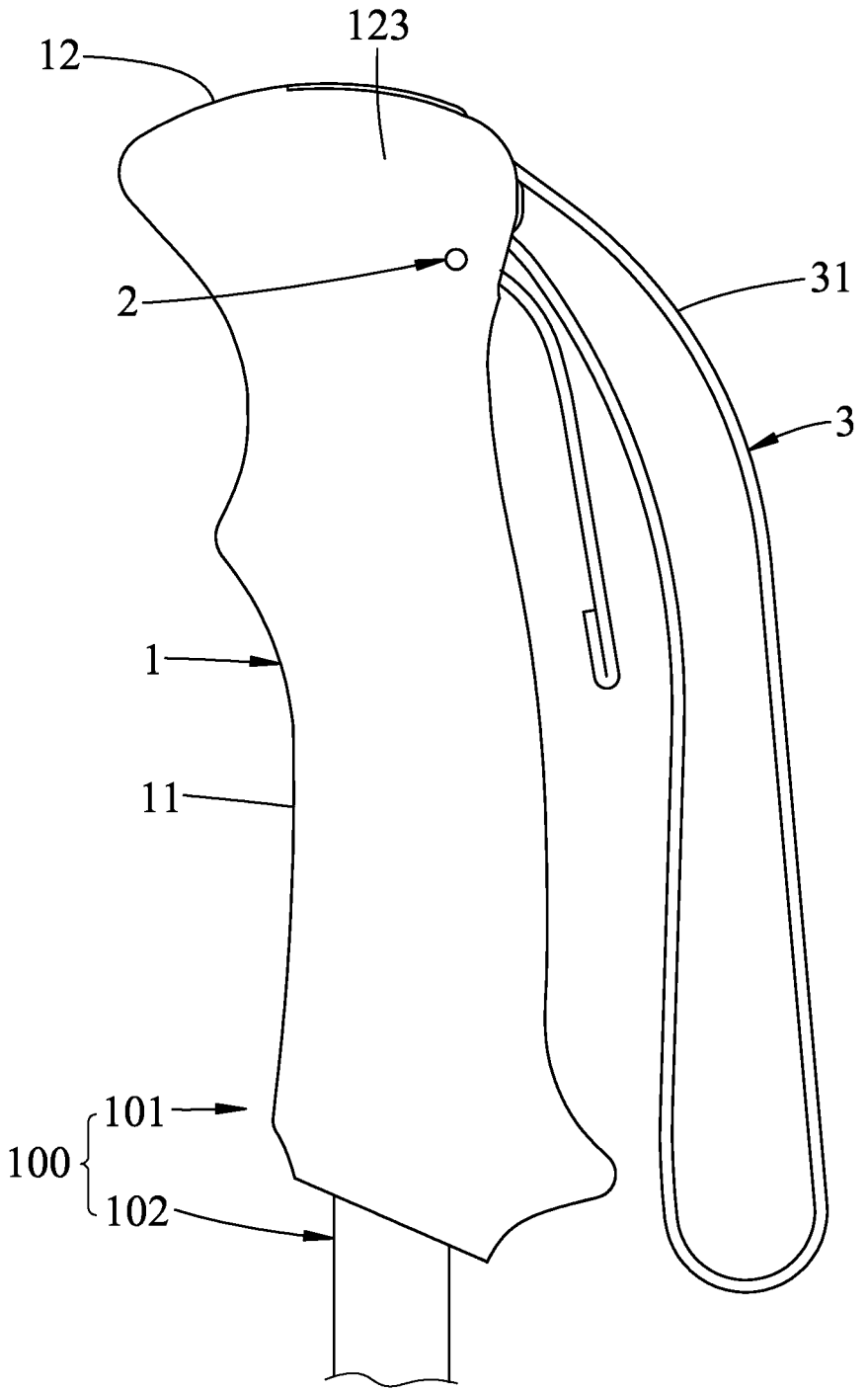
FIG. 1 is a fragmentary side view of a pole mounted with a first embodiment of a grip device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
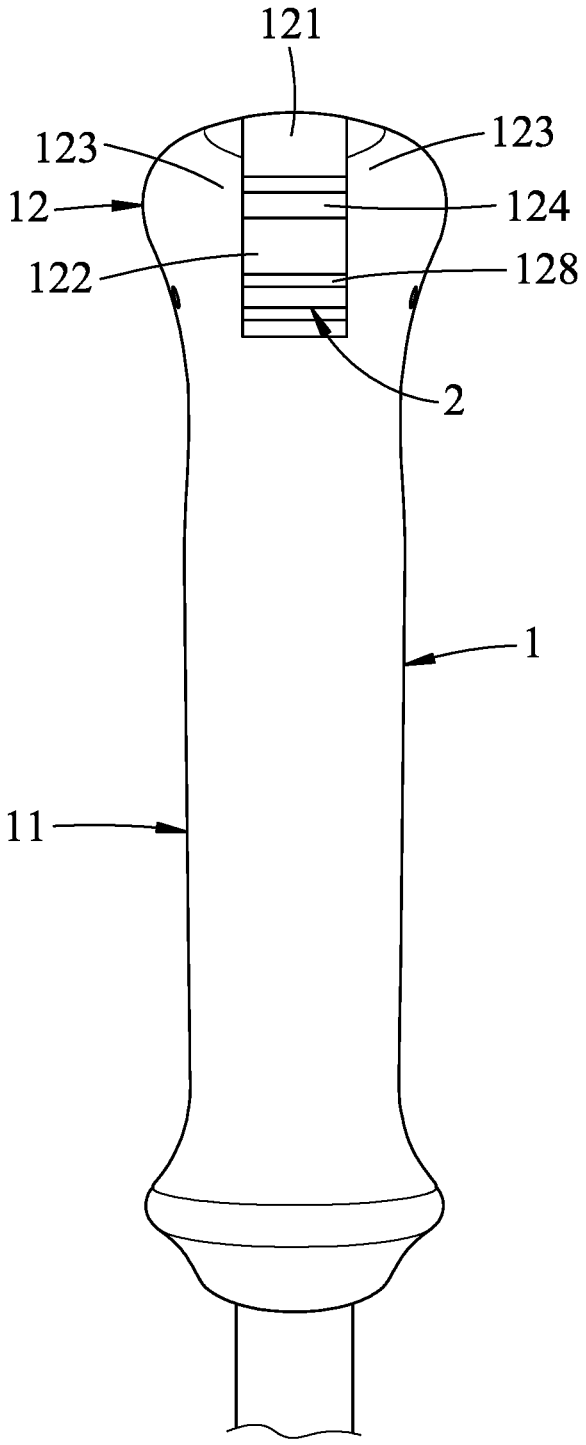
FIG. 2 is a fragmentary rear view of the pole mounted with the first embodiment, wherein a wrist strap unit is not shown.

Referring to FIGS. 1 and 2, a first embodiment of a grip device 101 according to the disclosure is adapted for use in a pole 100. The pole 100 includes the grip device 101 and a pole body 102. The first embodiment includes a grip 1, a rod 2, and a wrist strap unit 3.

Figure 3:
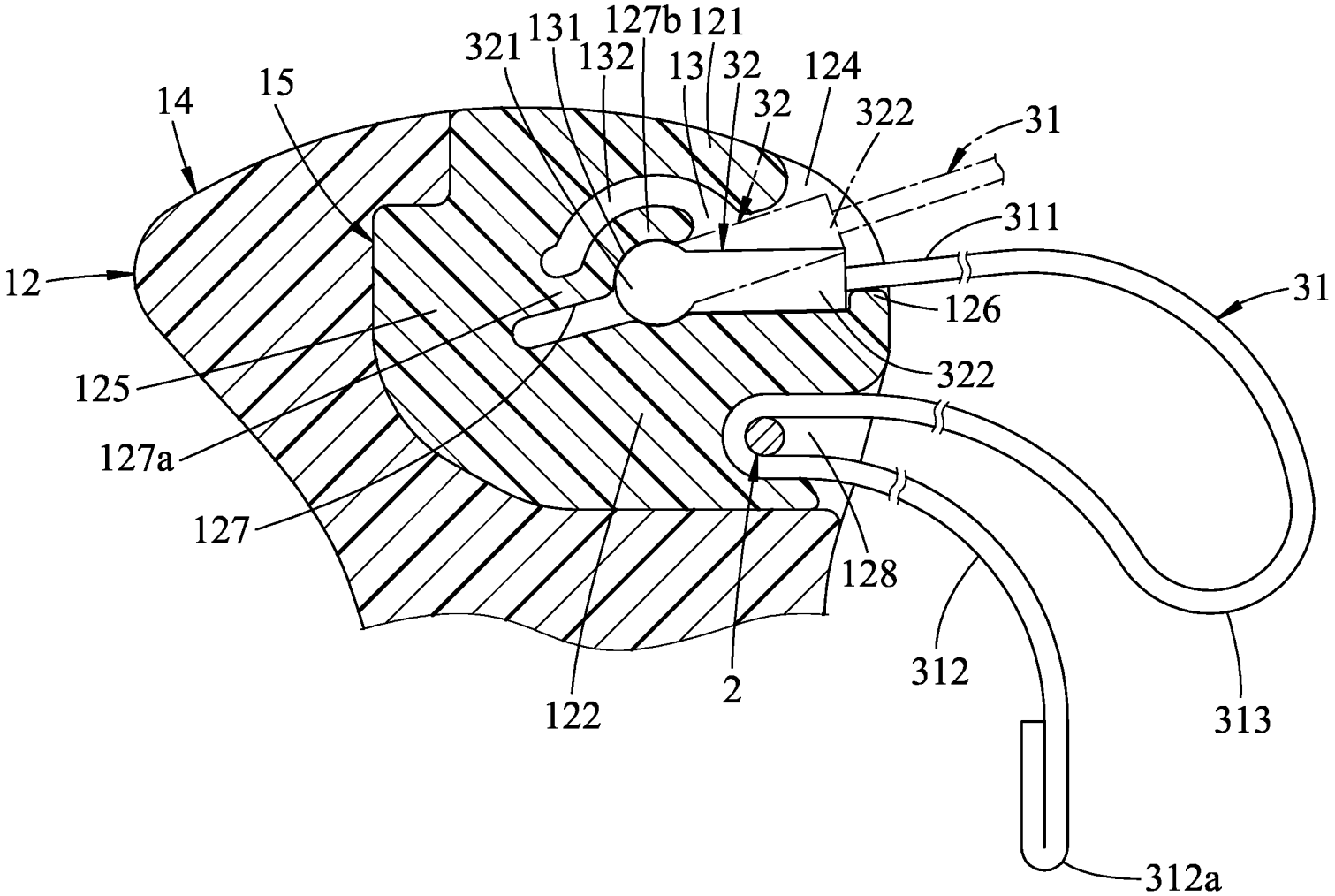
FIG. 3 is a fragmentary, partly sectional view illustrating a tail part of a connecting member of the wrist strap unit of the first embodiment being pivotable between a locked position (solid lines) and an unlocked position (phantom lines)

Referring further to FIG. 3, the grip 1 has a holding part 11 that is adapted to be connected to the pole body 102 and that is for being held by a user, and a connecting part 12 that defines a connecting space 13 therein, and that is connected to a top of the holding part 11.

The connecting part 12 has an upper portion 121, a lower portion 122, two side portions 123, an opening 124, a linking portion 125, a protruding portion 126, and an engaging member 127. The upper portion 121 is located over the connecting space 13 of the grip 1. The lower portion 122 is located under the connecting space 13, and is formed with a groove 128 that has an open end communicating with the external environment, and that is spaced apart from the connecting space 13. The side portions 123 are connected between the upper portion 121 and the lower portion 122, and are respectively located at two opposite sides of the connecting space 13. The opening 124 is located between the upper portion 121 and the lower portion 122 and between the side portions 123, and communicates with the connecting space 13 and the external environment. In addition, the opening 124 is located at a rear side of the connecting part 12, with the curve between the thumb and the forefinger located at a rear side of the grip device 101 and facing a front side of the grip device 101 when the user's hand properly grips onto the grip device 101. The linking portion 125 is connected between the upper portion 121 and the lower portion 122 and between the side portions 123, and is located on a side of the connecting space 13 opposite to the opening 124. The protruding portion 126 is connected to the lower portion 122, is disposed in the connecting space 13, and is adjacent to the opening 124. Specifically, the protruding portion 126 is a protrusion protruding from the lower portion 122 into the connecting space 13. The engaging member 127 has a fixed segment 127*a* extending from the linking portion 125 into the connecting space 13 between the upper portion 121 and the lower portion 122, and an engaging segment 127*b* extending from the fixed segment 127*a*.

The connecting space 13 of the grip 1 has a connecting zone 131 that is defined between the engaging member 127 and the lower portion 122 of the connecting part 12 of the grip 1, and a working zone 132 that is defined between the engaging member 127 and the upper portion 121 of the connecting part 12. The engaging segment 127*b* of the engaging member 127 is resiliently deformable relative to the fixed segment 127*a* of the engaging member 127 when an external force is exerted thereon.

In the first embodiment, the connecting part 12 of the grip 1 includes a grip body 14 that has the side portions 123 and that is integrally molded with the holding part 11 of the grip 1, and a mounting body 15 that has the upper portion 121, the lower portion 122, the linking portion 125, the protruding portion 126 and the engaging member 127, and that is mounted to the grip body 14. However, in other embodiments, the grip body 14, the mounting body 15 and the holding part 11 may be molded as one piece.

The rod 2 is mounted in the groove 128 of the lower portion 122 of the connecting part 12 of the grip 1, and has two opposite ends that respectively extend into the side portions 123 of the connecting part 12.

Figure 4:
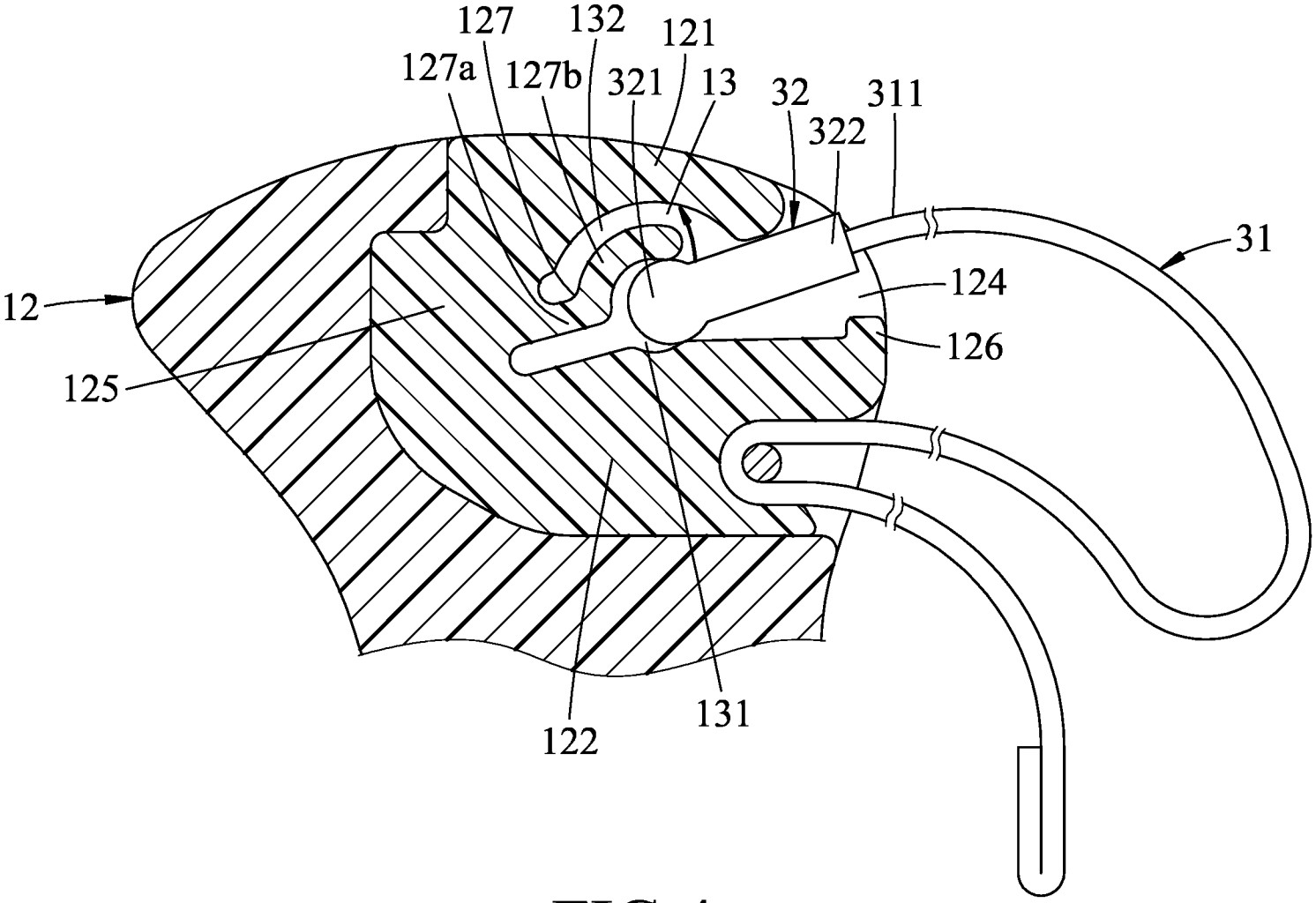
FIG. 4 is a fragmentary, partly sectional view illustrating an engaging segment of an engaging member being resiliently deformed by a head part of the connecting member.

Referring to FIGS. 3 and 4, the wrist strap unit 3 includes a connecting member 32 and a wrist strap 31. The connecting member 32 engages removably the connecting space 13 of the grip 1, and has a head part 321 and a tail part 322 that are respectively distal from and adjacent to the opening 124 of the connecting part 12 of the grip 1. The head part 321 is inserted removably into the connecting zone 131 of the connecting space 13, is engaged separably with the engaging segment 127*b* of the engaging member 127 of the connecting part 12, and has a round cross section. The engaging segment 127*b* has a surface that is in separable contact with the head part 321, that is arc-shaped (see FIG. 3), and that has a curvature equal to that of an outer surface of the head part 321. Therefore, the tail part 322 is pivotable, with the head part 321 serving as a pivot, between a locked position (see solid lines of the connecting member 32 in FIG. 3), where the tail part 322 is adjacent to the lower portion 122 of the connecting part 12 of the grip 1 so that the connecting member 32 is retained in the connecting space 13 by the protruding portion 126 of the connecting part 12, and an unlocked position (see phantom lines in FIG. 3), where the tail part 322 is away from the lower portion 122 and the protruding portion 126 of the connecting part 12 so that the connecting member 32 is permitted to be separated from the connecting part 12. Specifically, in the first embodiment, when the tail part 322 is at the locked position, the protruding portion 126 blocks a rear side of the tail part 322 so as to restrain the connecting member 32. Moreover, in the first embodiment, when the tail part 322 is at the unlocked position, the engaging segment 127*b* is resiliently deformed by the head part 321 in a manner that the connecting zone 131 is enlarged and the working zone 132 of the connecting space 13 is shrunk (see FIG. 4) upon exertion of a pulling force on the connecting part 32, so that the head part 321 is permitted to be disengaged from the engaging segment 127*b*, and be withdrawn from the connecting space 13.

The wrist strap 31 of the wrist strap unit 3 is connected to the tail part 322 of the connecting member 32 of the wrist strap unit 3, and has a connecting segment 311 and an adjusting segment 312. The connecting segment 311 is connected to the connecting member 32. The adjusting segment 312 has an end connected to the connecting segment 311, and an opposite end connected directly to the grip 1 so that the adjusting segment 312 cooperates with the connecting segment 311 and the grip 1 to form a loop 313 that is closed. Specifically, the opposite end of the adjusting segment 312 extends into the groove 128 of the lower portion 122 of the connecting part 12, passes through a gap defined between the rod 2 and a closed end of the groove 128 which is opposite to the open end of the groove 128, and extends out of the groove 128. The opposite end of the adjusting segment 312 is operable to move relative to the grip 1 so as to adjust a size of the loop 313. Furthermore, the adjusting segment 312 has a limiting end 312*a* that has a thickness larger than a width of the gap between the rod 2 and the closed end of the groove 128 so as to prevent the adjusting segment 312 from falling out of the groove 128. Therefore, the wrist strap 31 is prevented from being separated from the grip 1. It should be noted that, in the first embodiment, the limiting end 312*a* is formed by folding and sewing the opposite end of the adjusting segment 312 that extends out of the groove 128.

In practice, by virtue of the connecting member 32 of the wrist strap unit 3 engaging removably the connecting space 13 that is defined by the connecting part 12 of the grip 1, and the adjusting segment 312 of the wrist strap 31 of the wrist strap unit 3 being secured to the grip 1, the wrist strap 31 and the grip 1 form the closed loop 313, and the user can adjust the size of the loop 313 by moving the opposite end of the adjusting segment 312 relative to the grip 1. Therefore, the user can adjust the size of the loop 313 to tie around his/her wrist, and hold the holding part 11 with the corresponding hand to use the pole 100. In normal use, the hand used to hold the pole 100 and the wrist tied by the wrist strap 31 are both closer to the ground than the opening 124 of the connecting part 12, so the tail part 322 of the connecting member 32 is generally at the locked position. Even if the tail part 322 of the connecting member 32 is displaced to the unlocked position, exertion of a relatively great pulling force on the connecting part 32 is still needed to resiliently deform the engaging segment 127*b* of the engaging member 127 and to remove the connecting member 32 from the connecting space 13. That is to say, in normal use, the connecting member 32 can be retained in the connecting space 13 (i.e., the connecting member 32 engages the connecting part 12) by virtue of the engaging member 127 and the protrusion portion 126 of the connecting part 12. Hence, the wrist strap unit 3 is able to offer reliable connection between the grip 1 and the hand and wrist of the user.

However, if the user loses his/her grip on the holding part 11 of the grip 1 when the user falls down, or when the pole 100 is stuck into the ground or snow, the hand used to hold the pole 100 and the wrist tied by the wrist strap 31 of the wrist strap unit 3 will move upward relative to the opening 124 of the connecting part 12 of the grip 1 such that the tail part 322 of the connecting member 32 of the wrist strap unit 3 is drawn by the wrist strap 31 to the unlocked position. In the meantime, the user will exert a relatively great pulling force on the connecting part 32 to deform the engaging segment 127*b* of the engaging member 127 of the connecting part 12 and to remove the connecting member 32 from the connecting space 13, which leads to separation of the connecting member 32 and the connecting part 12, and further leads to separation of the connecting segment 311 of the wrist strap 31 and the grip 1. As a result, the hand and the wrist of the user are no longer strapped to the pole 100, and thus injuries to the user's hand or wrist can be prevented by disengaging the tie between the user and the pole 100.

Moreover, when the connecting member 32 of the wrist strap unit 3 is separated from the connecting part 12, the user can exert a force on the connecting member 32 to urge the head part 321 of the connecting member 32 to resiliently deform the engaging segment 127*b* of the engaging member 127 so as to insert the head part 321 into the connecting zone 131 of the connecting space 13 such that the connecting member 32 is connected to the connecting part 12 again.

Figure 5:
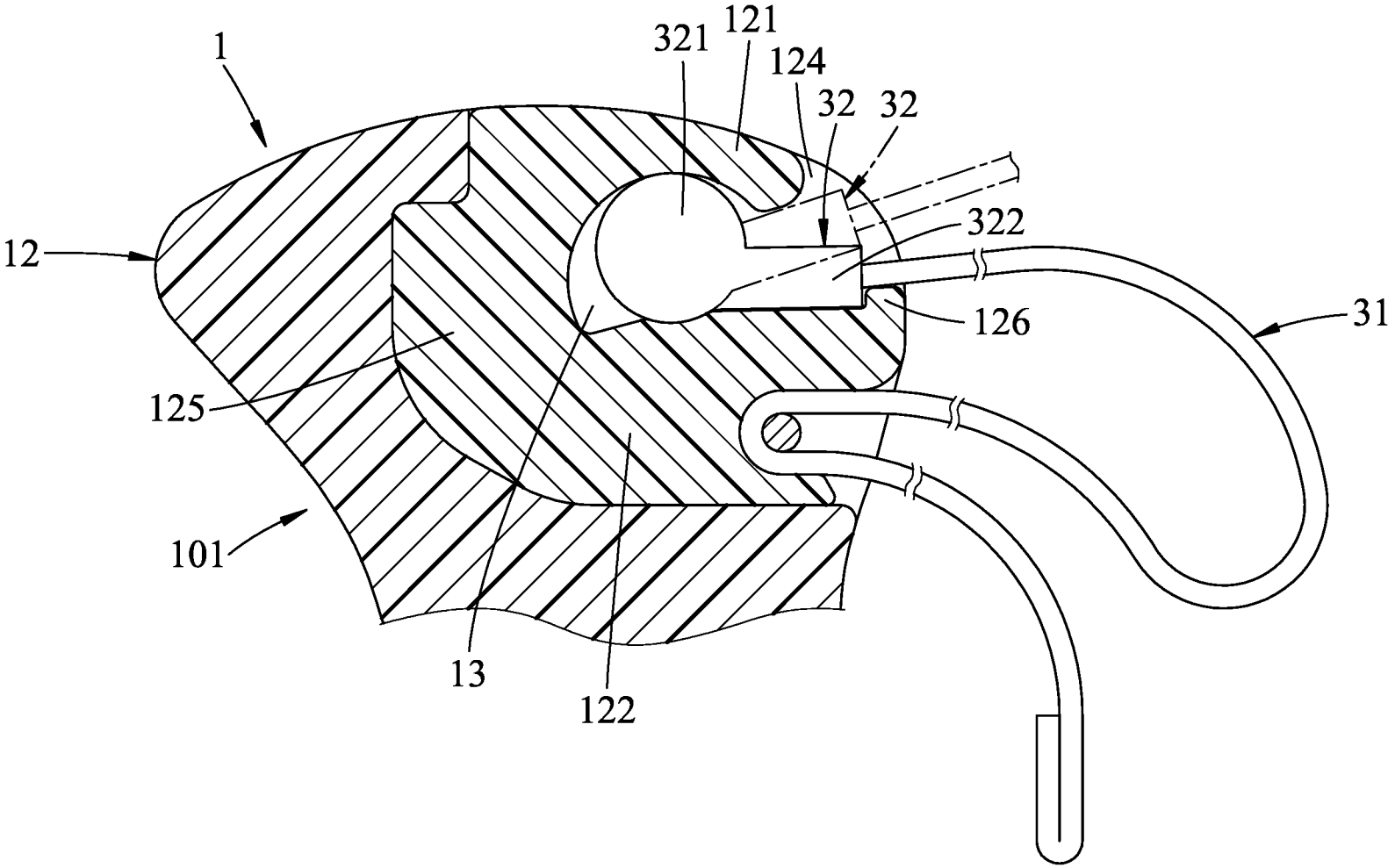
FIG. 5 is a fragmentary, partly sectional view of a second embodiment of the grip device for the pole according to the disclosure.

Referring to FIG. 5, a second embodiment of the grip device 101 according to the disclosure is similar to the first embodiment. A distinctive difference between the first embodiment and the second embodiment is omission of the engaging member 127 of the connecting part 12 of the grip 1 in the second embodiment.

In the second embodiment, the upper portion 121 of the connecting part 12 of the grip 1 is resiliently deformable relative to the linking portion 125 of the connecting part 12. The head part 321 of the connecting member 32 of the wrist strap unit 3 is inserted removably into the connecting space 13 of the grip 1, and is engaged separably with the upper portion 121 of the connecting part 12. The tail part 322 of the connecting member 32 is pivotable, with the head part 321 serving as the pivot, between the locked position (see solid lines of the connecting member 32 in FIG. 5), and the unlocked position (see phantom lines in FIG. 5). When the tail part 322 is at the unlocked position, the upper portion 121 is resiliently deformed by the head part 321 upon exertion of a pulling force on the connecting part 32, so that the head part 321 is permitted to be disengaged from the upper portion 121. Therefore, the second embodiment is able to achieve the same improvements as the first embodiment.

In summary, the tail part 322 of the connecting member 32 of the wrist strap unit 3 is pivotable between the locked position and the unlocked position when the connecting member 32 engages the connecting space 13 of the grip 1. In addition, the connecting member 32 is permitted to be separated from the connecting part 12 by exertion of a relatively great pulling force thereon when the tail part 322 is at the unlocked position. Therefore, by virtue of the connecting member 32 and the connecting part 12 of each of the embodiments of the grip device 101 for the pole 100 according to the disclosure, the hand and the wrist of the user are no longer strapped to the pole 100 when the user of the pole 100 falls down, or when the pole 100 is stuck by the external environment. Consequently, the user can avoid danger and injuries caused by using the pole 100, and the purpose of the disclosure can certainly be fulfilled.

In the description above, for the purposes of explanation, numerous specific details have been set forth in order to provide a thorough understanding of the embodiments. It will be apparent, however, to one skilled in the art, that one or more other embodiments maybe practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A grip device for a pole, said grip device comprising:

a grip having a connecting part that defines a connecting space therein, said connecting part having an upper portion that is located over said connecting space, a lower portion that is located under said connecting space, an opening that is located between said upper portion and said lower portion and that communicates with said connecting space and the external environment, and a protruding portion that is connected to said lower portion, that is disposed in said connecting space, and that is adjacent to said opening; and a wrist strap unit including a connecting member that engages removably said connecting space, and that has a head part and a tail part which are respectively distal from and adjacent to said opening of said connecting part of said grip, said tail part being pivotable, with said head part serving as a pivot, between a locked position, where said tail part is adjacent to said lower portion of said connecting part of said grip so that said connecting member is retained in said connecting space by said protruding portion of said connecting part, and an unlocked position, where said tail part is away from said lower portion and said protruding portion of said connecting part so that said connecting member is permitted to be separated from said connecting part, and a wrist strap that is connected to said tail part of said connecting member;

wherein when said tail part of said connecting member is at the locked position, said protruding portion blocks a rear side of said tail part so as to restrain said connecting member;

wherein said protruding portion of said connecting part of said grip is a protrusion protruding from said lower portion into said connecting space;

wherein said connecting part of said grip further has a linking portion that is connected between said upper portion and said lower portion and that is located on a side of said connecting space opposite to said opening, and an engaging member that has a fixed segment extending from said linking portion into said connecting space between said upper portion and said lower portion, and an engaging segment extending from said fixed segment and being resiliently deformable relative to said fixed segment;

wherein said head part of said connecting member of said wrist strap unit is engaged separably with said engaging segment of said engaging member; and wherein when said tail part of said connecting member is at the unlocked position, said engaging segment of said engaging member is resiliently deformed by said head part of said connecting member upon exertion of a pulling force on said connecting part, so that said head part is permitted to be disengaged from said engaging segment of said engaging member.

2. The grip device as claimed in claim 1, wherein:

said connecting space has a connecting zone that is defined between said engaging member and said lower portion of said connecting part of said grip, and a working zone that is defined between said engaging member and said upper portion of said connecting part;

said head part of said connecting member of said wrist strap unit is inserted removably into said connecting zone of said connecting space; and when said tail part of said connecting member is at the unlocked position, said engaging segment of said engaging member is resiliently deformed by said head part of said connecting member in a manner that said connecting zone is enlarged and said working zone is shrunk, so that said head part is permitted to be withdrawn from said connecting space.

3. The grip device as claimed in claim 1, wherein:

said head part of said connecting member of said wrist strap unit has a round cross section; and said engaging segment of said engaging member of said connecting part of said grip has a surface that is in separable contact with said head part of said connecting member, that is arc-shaped, and that has a curvature equal to that of an outer surface of said head part of said connecting member.

4. The grip device as claimed in claim 1, wherein:

said grip further has a holding part that is for being held by a user;

said connecting part of said grip is connected to a top of said holding part; and said opening of said connecting part is located at a rear side of said connecting part.

5. The grip device as claimed in claim 1, wherein said wrist strap of said wrist strap unit has a connecting segment that is connected to said connecting member of said wrist strap unit, and an adjusting segment that has an end connected to said connecting segment, and an opposite end connected directly to said grip so that said wrist strap and said grip form a loop that is closed.

6. The grip device as claimed in claim 5, wherein said adjusting segment of said wrist strap of said wrist strap unit is operable to move relative to said grip so as to adjust a size of said loop.

7. The grip device as claimed in claim 6, wherein:

said lower portion of said connecting part of said grip is formed with a groove that has an open end communicating with the external environment and that is spaced apart from said connecting space of said grip;

said grip device further comprises a rod mounted in said groove; and said opposite end of said adjusting segment of said wrist strap of said wrist strap unit extends into said groove, passes through a gap defined between said rod and a closed end of said groove which is opposite to said open end of said groove, and extends out of said groove, said opposite end of said adjusting segment being movable to adjust the size of said loop.

8. The grip device as claimed in claim 7, wherein said adjusting segment of said wrist strap has a limiting end that has a thickness larger than a width of said gap between said rod and said closed end of said groove so as to prevent said wrist strap from falling out of said groove.

9. A grip device for a pole, said grip device comprising:

a grip having a connecting part that defines a connecting space therein, said connecting part having an upper portion that is located over said connecting space, a lower portion that is located under said connecting space, an opening that is located between said upper portion and said lower portion and that communicates with said connecting space and the external environment, and a protruding portion that is connected to said lower portion, that is disposed in said connecting space, and that is adjacent to said opening; and a wrist strap unit including a connecting member that engages removably said connecting space, and that has a head part and a tail part which are respectively distal from and adjacent to said opening of said connecting part of said grip, said tail part being pivotable, with said head part serving as a pivot, between a locked position, where said tail part is adjacent to said lower portion of said connecting part of said grip so that said connecting member is retained in said connecting space by said protruding portion of said connecting part, and an unlocked position, where said tail part is away from said lower portion and said protruding portion of said connecting part so that said connecting member is permitted to be separated from said connecting part, and a wrist strap that is connected to said tail part of said connecting member:

wherein when said tail part of said connecting member is at the locked position, said protruding portion blocks a rear side of said tail part so as to restrain said connecting member;

wherein said protruding portion of said connecting part of said grip is a protrusion protruding from said lower portion into said connecting space;

wherein said connecting part of said grip further has a linking portion that is connected between said upper portion and said lower portion and that is located on a side of said connecting space opposite to said opening;

wherein said upper portion of said connecting part is resiliently deformable relative to said linking portion;

wherein said head part of said connecting member of said wrist strap unit is engaged separably with said upper portion of said connecting part; and wherein when said tail part of said connecting member is at the unlocked position, said upper portion of said connecting part is resiliently deformed by said head part of said connecting member upon exertion of a pulling force on said connecting part, so that said head part is permitted to be disengaged from said upper portion of said connecting part.

* * * * *